United States Patent [19]

Downing

[11] Patent Number: 4,887,741

[45] Date of Patent: Dec. 19, 1989

[54] THERMAL ADHESIVE APPLICATOR

[76] Inventor: Donald M. Downing, 4408 S. 44th W. Ave., Tulsa, Okla. 74107

[21] Appl. No.: 175,108

[22] Filed: Mar. 30, 1988

[51] Int. Cl.[4] ..... B67D 5/62

[52] U.S. Cl. ..... 222/146.5; 222/504; 404/94

[58] Field of Search ..... 222/145, 149, 146.2, 222/146.5, 322, 501, 504; 239/116–118, 584; 404/15–16, 75, 84, 93–94; 401/2

[56] References Cited

U.S. PATENT DOCUMENTS

| | | | |
|---|---|---|---|
| 2,898,825 | 8/1959 | Walker et al. | 404/12 |
| 3,266,392 | 8/1966 | Angelini | 404/94 |
| 3,443,494 | 5/1969 | Boettler et al. | 404/75 |
| 3,540,358 | 11/1970 | Oakley | 404/84 |
| 3,554,449 | 1/1971 | Currie | 239/135 |
| 3,590,701 | 7/1971 | Ten Broeck | 404/84 |
| 3,867,120 | 2/1975 | Schaefer | 65/62 |
| 3,876,857 | 4/1975 | Dhillon | 219/230 |
| 4,135,991 | 1/1979 | Clark et al. | 404/73 |
| 4,332,335 | 6/1982 | Fiorentini | 222/145 |
| 4,373,670 | 2/1983 | Kilner | 239/172 |
| 4,376,007 | 3/1983 | Eigenmann | 156/497 |
| 4,376,244 | 3/1983 | Gellert | 222/146.5 X |
| 4,523,696 | 6/1985 | Commette et al. | 222/149 X |

FOREIGN PATENT DOCUMENTS

| | | | |
|---|---|---|---|
| 3018693 | 11/1981 | Fed. Rep. of Germany | 404/94 |
| 2575497 | 7/1986 | France | 404/94 |

*Primary Examiner*—Michael S. Huppert
*Attorney, Agent, or Firm*—Head & Johnson

[57] ABSTRACT

An apparatus for securing reflectors to a road bed. The apparatus deposits a small amount of hot liquid bitumen to the surface of the road and before it cools a reflector is set therein. The apparatus includes a vat for heating the bitumen to about 425° F. An articular heated, insulated dispensing conduit connects the output of the vat to a vertical dispensing valve which when actuated deposits a selected amount of liquid bitumen on the pavement. A pump assembly is connected to the output of the vat and is directed into the dispensing conduit and a dispensing valve is provided at the end of the conduit. The whole system is supported on a trailer which is pulled by a truck. The operator sits in a suspended chair and guides the dispensing valve as necessary to obtain the correct location for the reflectors. A foot switch is provided to actuate the pump assembly and valve in a coordinated fashion.

8 Claims, 12 Drawing Sheets

THERMAL ADHESIVE APPLICATOR

BACKGROUND OF THE INVENTION

This invention relates to an apparatus and method of placing reflectors on the surface of a roadway at selected locations.

This country is criss-crossed by hundreds of thousands of miles of highways. Most of these roads have some markings on the surface such as painted lines to denote the center of the highway on two lane roads and to denote the lanes on four or more lane divided highways. Sometimes the lines are painted to show where the edge of the road is. These paintings are, of course, quite helpful. However, the paint does tend to wear away and sometimes it is difficult to see it on a rainy, dark night. One method of marking roads, which for some areas replaces the painted lines, is the securing of reflectors to the roadway at selected locations. These reflectors are extremely helpful to motorists on dark, rainy nights inasmuch as they show the driver where the roadway actually is.

There have been numerous ways of securing these reflectors to the surface of the roadway. One common way is to apply an epoxy at selected spaced locations along the roadway and then place the reflectors in the epoxy bottle and let the epoxy cure. This system is rather costly and takes considerable time for the epoxy to dry. It has been estimated that at this time the cost of installation using epoxy for each reflector is one dollar and sixty-five cents, not counting cost of the reflector.

The prior devices for depositing a settable material for reflectors is typically of the gear type pumping mechanism which becomes clogged quite frequently. These prior devices normally require two people to operate.

It is therefore an object of this invention to provide a novel, thermal adhesive applicator for use in securing reflectors or other driving assistance objects to the road.

It is a still further object of this invention to provide a novel thermal adhesive applicator which can be operated by one person.

It is still another object of this invention to provide a trailer supported thermal adhesive applicator in which the operator can maneuver the adhesive dispensing valve to deposit the adhesive at the desired locations while the trailer is being pulled down the highway.

SUMMARY OF THE INVENTION

This is a new self-contained thermal adhesive applicator for use in securing reflectors or other traffic control devices to the roadway of a highway. The whole system is supported on a trailer which may be pulled behind a truck. The frame of the trailer supports a vat into which bitumen is placed. A heater heats the bitumen to about 425° F. where it becomes a liquid which can be pumped. The temperature is thermostatically controlled. A stirrer is provided and may be either hand operated or driven by a motor. The vat has an outlet which is attached to a pump assembly.

An operator seat is positioned to one side of the frame of the trailer. An articulated conduit extends from the outlet of the pump assembly to a bitumen dispensing valve which has an upstanding handle which can be grasped by the operator. The conduit is made of a first part and a second part. The first part is pivotally connected to the output of the pump assembly and a swivel assembly connects the two sections. The swivel assembly and the second section are supported from the frame in a manner such that the operator can move the dispensing valve either closer to or further away from the trailer or front and back as may be needed so that the adhesive, which preferably is the liquid bitumen, will be deposited at the correct spot.

The pump assembly and the end dispensing valve are air operated in a coordinated fashion such that the dispensing valve is opened before the pump assembly operates to pump the liquid bitumen. A foot switch is provided whereby the operator can cause the valve and pump assembly to operate. The length of travel of the pump assembly which can be adjusted controls the amount of Bitumen pumped.

There are numerous safety features in this assembly. It is so designed that the pump assembly is not operative until the dispensing valve is open. This prevents any build up of pressure in the conduit which might rupture and spew hot liquid bitumen on someone. Another safety feature is provided. The seat and the dispensing valve can be pivoted about pivot points whereby the second section is an upright position and can be locked therein. When in this position a valve operates in the swivel assembly to close the conduit so that hot fluid cannot be pumped therethrough when the dispensing valve is in this upright position. Another safety feature is that I can cause the pump assembly drive to be locked in a non-operating position.

DETAILED DESCRIPTION

Figure 1:
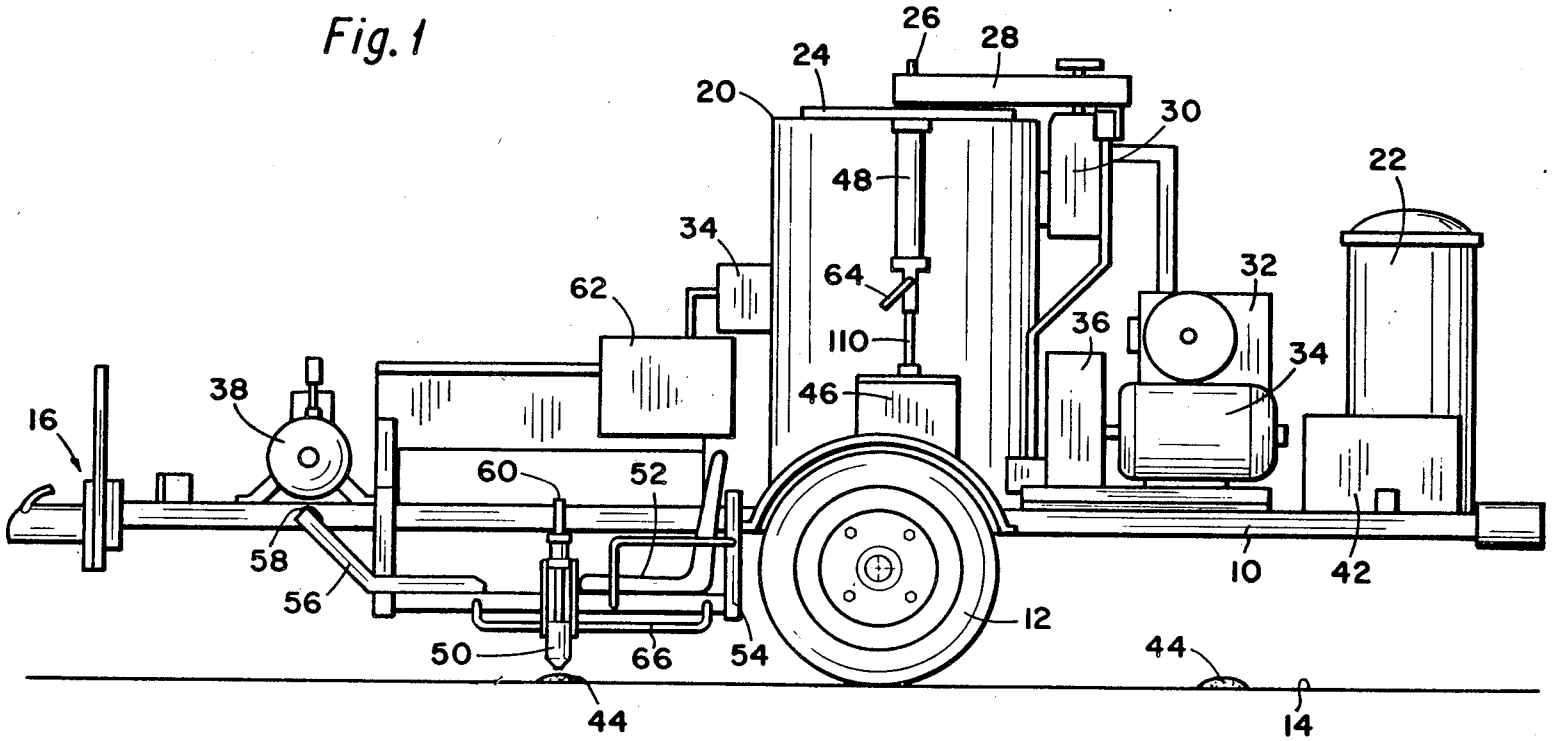
FIG. 1 is an elevation view of my thermal adhesive applicator.
Figure 1A:
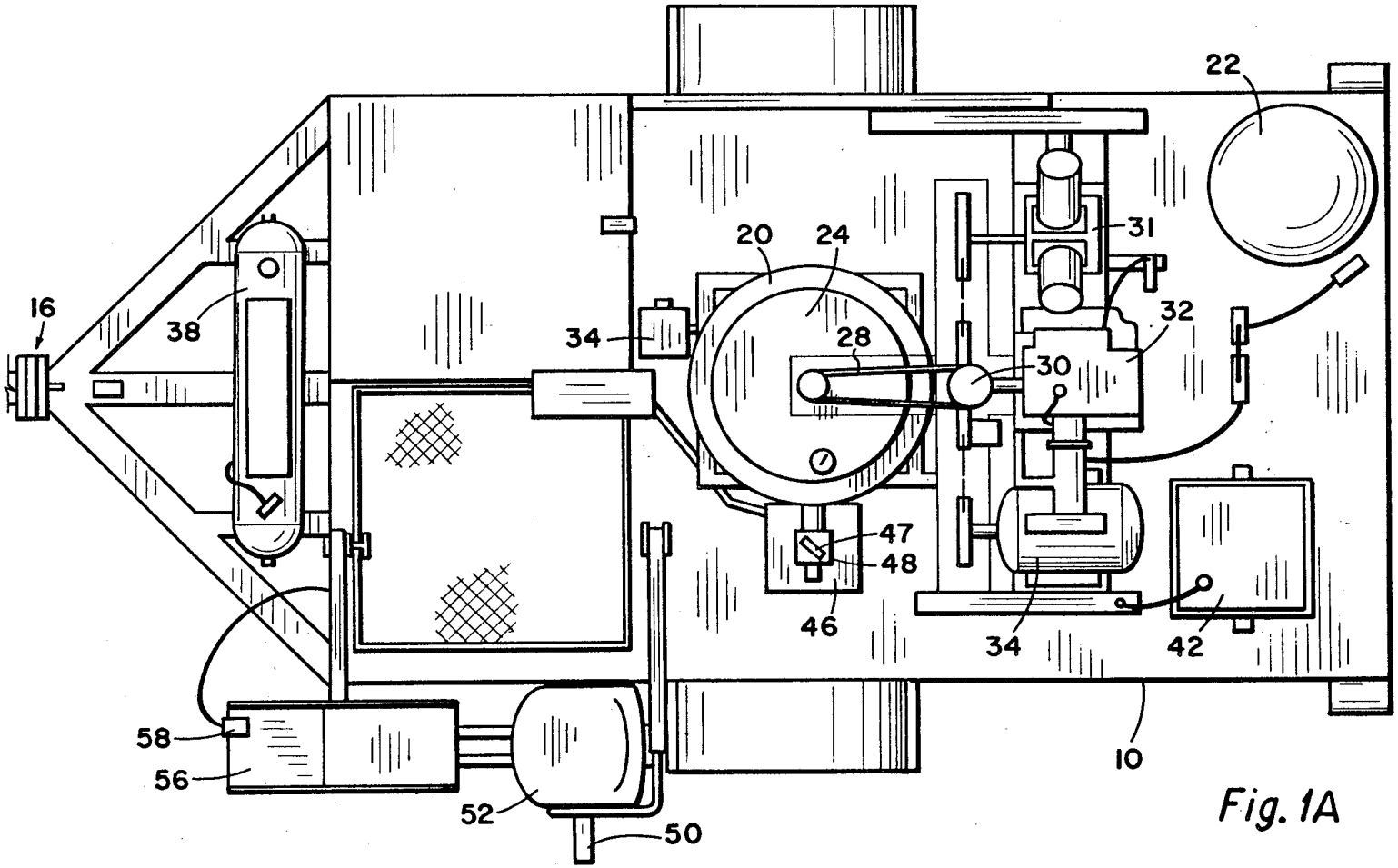
FIG. 1A is a plan view of the thermal adhesive applicator of FIG. 1.

Attention is first directed to FIGS. 1 and 1A which shows in schematic form the major components of my self-contained thermal adhesive applicator. Shown thereon is a frame 10 supported by wheels 12 above the surface 14 of the roadway. A trailer hitch 16 at the front of the applicator permits the applicator to be attached to a truck for towing. A vat 20 is supported above the frame 10 and is typically a twenty-four gallon material container with insulation applied to the outside thereof. It is heated by a large burner which typically would be a sixty thousand BTU burner which is provided with fuel from a propane tank 22 which is placed at the rear end of the trailer. Of course other size vats and other type energy can be used to heat the vat. The vat 20 is provided with a lid 24. A handle 26 drives an agitator or stirrer, not shown, within the vat 20. A drive chain 28 can be used as an optional means of driving the agitator or stirrer within the vat and can be driven by a motor 30. On the rear of the frame next to the propane tank 22 is a powerplant which includes a generator engine 32 which is preferably to be driven by fuel from the propane tank. Generator engine 32 drives generator 34 and an air compressor 31 (shown in FIG. 1A) through drive belts which are contained in belt guard housing 36. Details of this will not be shown inasmuch as it is well known to have this type of power plant. The air from the air compressor is stored in pressure air tank 38 which is located near the front of the frame 10. A battery 42 is provided near the end of frame 10 and is used with the power plant.

We will now discuss a few of the components which are used in dispensing the fluid heated in vat 20 to deposit an adhesive lump or puddle 44 on the surface 14. This includes a pump 46 with a free floating piston which is adjacent an outlet on the insulating vat 20 and is driven by a cylindrical motor 48. The length of the stroke of motor 48 can be changed by using adjustment handle 47 which can adjust the position of the stop which limits the upward movement of the piston in pump 48. A heated articulated conduit which will be discussed in relation to FIG. 2 connects the outlet of pump 46 with the dispensing valve 50 which is used to dispense the adhesive 44 on the surface 14. An operator seat 52 is supported by frame 54 from main frame 10. Support frame 54 also supports a foot rest 56 and a foot switch 58. Dispensing valve 50 has a guiding handle 60 which the operator, when seating in seat 52, can hold onto and move it either in a forward or backward direction with respect to the trailer or an in and out lateral position with respect to the longitudinal axis of the trailer so that it can deposit an adhesive lump 44 at a selected spot.

A safety control valve 64 is provided for the air supply to cylindrical motor 48 below its piston and when in the opened position permits motor 48 to operate normally, but when valve 64 is closed it prevents normal operation of the motor and will hold pump 46 in a down position as will be more clearly described later.

There is also a dispensing conduit support 66 which supports the section of the dispensing conduit leading to dispensing valve 50.

In operation the operator sits in seat 52 with his foot near the foot switch 58 and his hand on the handle 60. As the trailer is pulled down the road, the operator will guide the dispensing valve 50 to the correct position either in or out and when it gets at the correct spot he presses foot switch 58 with his foot which will dispense an adhesive mass 44. The best adhesive found by applicant is Bitumen which sets up quickly, but before it sets a reflector or other traffic assistance object is placed into the Bitumen 44 pile. Within a few minutes the Bitumen will adhere both to the surface 14 of the roadway and to the object such as a reflector which is placed therein. Valve 50 may be called a drip free dispensing valve. I have found that if I heat Bitumen to approximately 425° F. that it will flow through my system real well and will set quickly upon cooling when placed in the piles 44. In this regard there is also provided a gas control box 34 which thermostatically controls the amount of heat applied to the vat 20. A control box 62 is provided for the electrical system.

Figure 2:
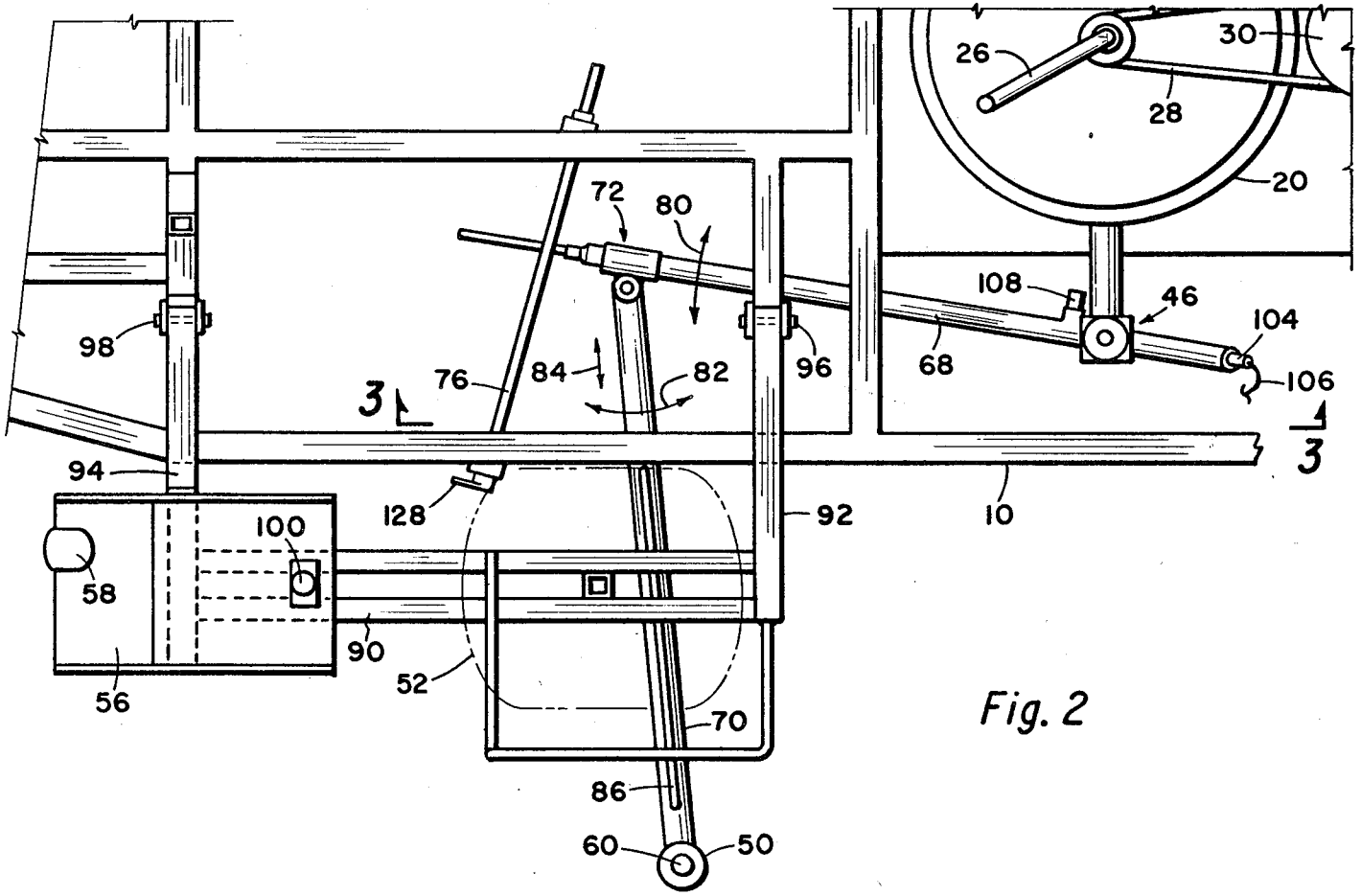
FIG. 2 is a plan view with the decking removed from the frame showing the vat and the fluid flow conduits to a dispensing valve.
Figure 3:
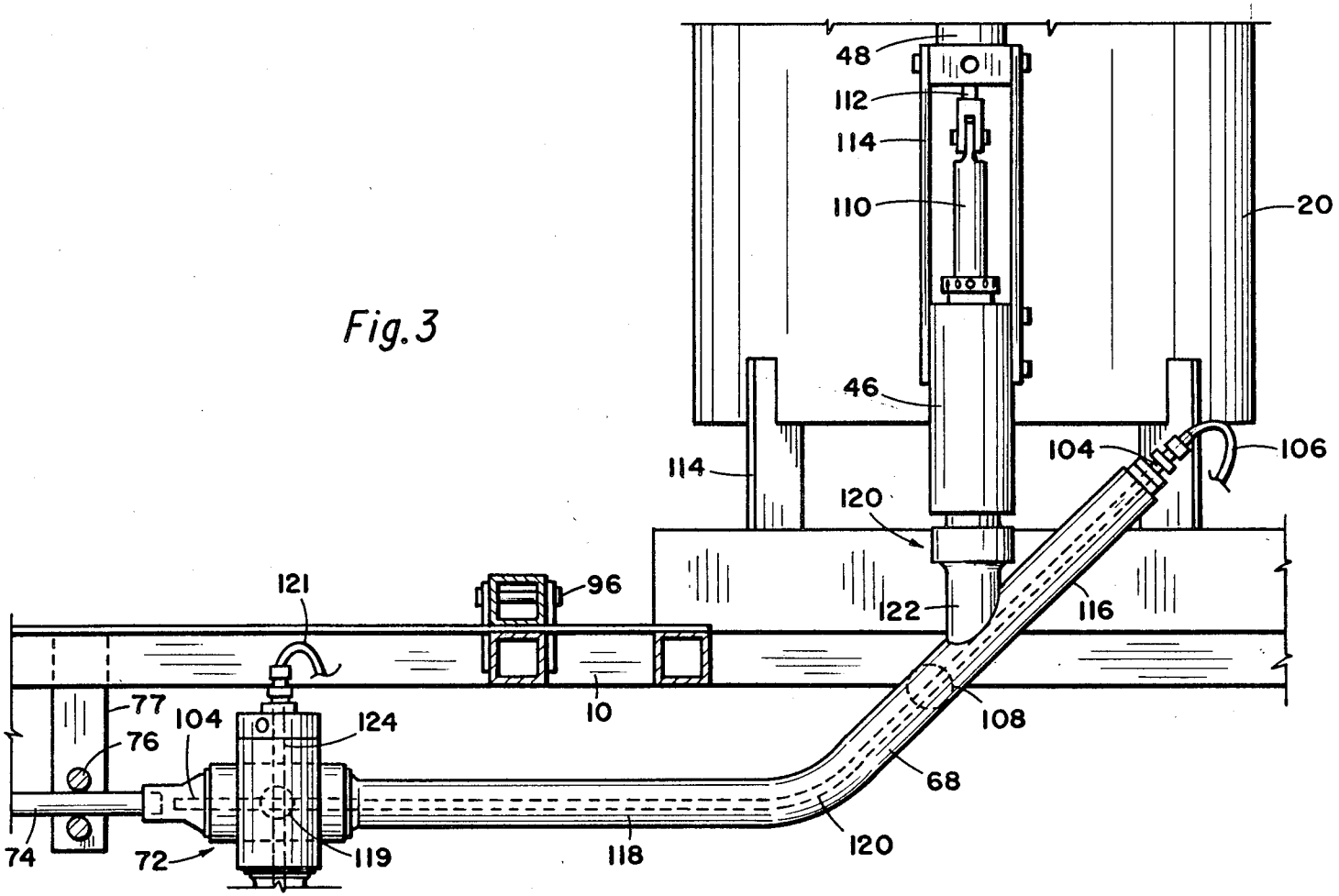
FIG. 3 illustrates an enlarged view of the conduit from the pump and at the vat to the swivel assembly for the dispensing conduit and is a view taken along the line 3—3 of FIG. 2.
Figure 4:
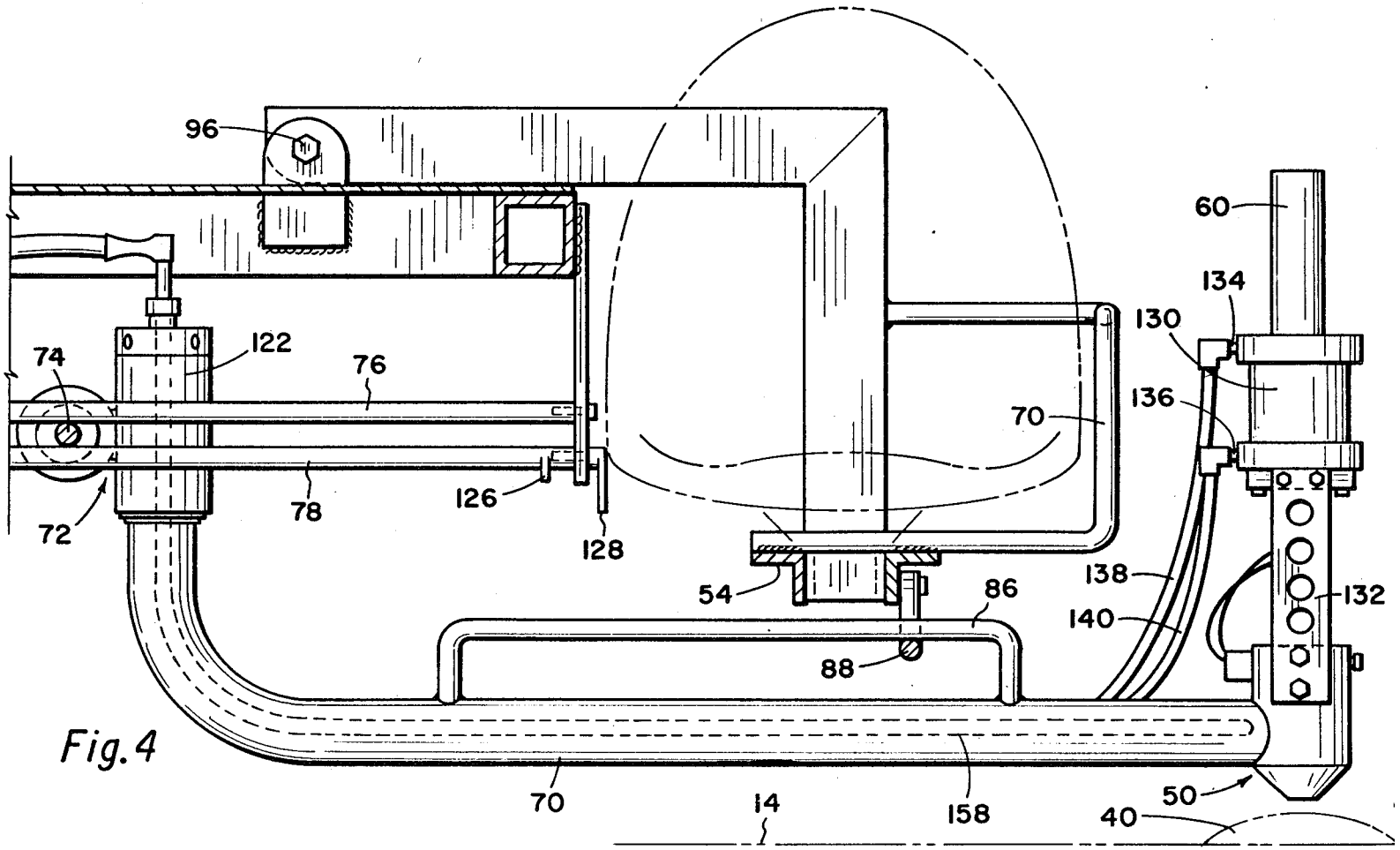
FIG. 4 shows a second part of the fluid dispensing conduit from the swivel assembly to the dispensing valve and is a view taken along the line 4—4 of FIG. 2.

Attention is next directed to FIG. 2 which illustrates the fluid dispensing conduit system from the pump assembly 46 to the non-drip dispensing valve 50. Essentially the entirety of the fluid transfer conduit is insulated and heated. This dispensing conduit includes a first section 68 and a second section 70 which are connected together by swivel assembly 72. The first section 68 is pivotally connected to the output of pump assembly 46. As shown in FIG. 3, one end of the second section 70 is connected to the input of dispensing valve 50. A short slide bar 74 extends outwardly from the swivel assembly 72 and extends between an upper slide bar 76 and a lower slide bar guide 78 both supported from frame 10 by end support 77 and another support (not shown) bar 78 may rotate. First section 68 has a pivotal motion about pump 46 as indicated by arrow 80. Second conduit section 70 has rotational movement as indicated by arrows 82 about the swivel assembly 72. The second section of the dispensing conduit can move laterally as indicated by arrow 84. The swivel assembly is supported during this movement by the short slide bar 74 which as shown in FIG. 3 is supported between rods 76 and 78 which are supported from the frame. The second section of the dispensing conduit 70 is supported by a support hook 86 from support rod 88 as shown in FIG. 4 which is supported from the seat frame 54. As seat support frame 90 has end members 92 and 94 which are pivotally supported at pivots 96 and 98, respectively, from the main frame 10. An adjustable knob and clamp 100 permits the adjustment of the foot support 56 to fit the particular operator when sitting in seat 52 which is supported from seat support 90.

As mentioned above if one is using Bitumen as its thermal adhesive then it is essential to maintain it as close as possible to 425° F. If it should get much higher, for example, 500° F. the Bitumen would become very hard and if it is much lower it would not flow properly. As stated, the vat 20 is insulated and heat controlled. Pump assembly 46 and all conduits between the vat and the dispensing valve 50 are insulated and heated. As shown in FIG. 3, the first section 68 of the fluid transport conduit system is provided with an internal heating element 104 which is provided with an electrical lead 106 which goes to control box 62 as is also a lead from thermocouple 108 which is provided adjacent the pump assembly 46 discharge and the temperature is thermostatically controlled in a known manner, therefore, details of it will not be discussed. The section 70 is likewise provided with internal heating element 122 supplied by electrical lines 121 and controlled by thermostat 119.

FIG. 3 which is a view taken along the line 3—3 of FIG. 2 shows an enlarged portion of the first part or section 68 of the dispensing conduit. The pump 46 will be described in detail in regards to FIGS. 5, 6, 7, 8 and 9. As shown in FIG. 3 the piston rod 110 extends up through the upper end of pump 46 and is connected to extension rod 112 of air pump cylinder 48. This air cylinder has a piston therein (not shown) and there are port means providing air to beneath the piston and air to above the piston in a manner to drive the piston in the piston rod 112. This type movement is well known and no detailed discussion will be made. Support bars 114 connect the housing of the pump cylinder 48 and the housing of the pump 46. It also will be noted that vat 20 is supported by support frame 114 from the main frame 10. Section 68 of the dispensing conduit has a first part 116 which is sloping and a second part 118 which is substantially horizontal. A pivot joint 120 connects the output of pump 46 to a nipple 122 which is in fluid communication with the interior of section 116. Thus, the first section 68 of the dispensing conduit can pivot about an axis which is in line with the longitudinal axis of cylindrical housing of pump 46. The end of conduit section 68 away from the pump is connected to the swivel assembly 72. The swivel joint 72 is also provided with internal heating element 124 which is a part of element 106 and 121 which is a part of heating element 138 of conduit section 70 as shown in FIG. 4. These heating elements are provided with electrical connectors in a known manner. A thermostat 119 is provided to control the heat to element 122. The swivel assembly 72 permits the motions described above in regard to the discussion in FIG. 2. Details of swivel assembly 72 will be discussed with FIGS. 14, 15, 16 and 17.

Attention is now directed to FIG. 4 which illustrates the second section of the dispensing conduit.

Figure 11:
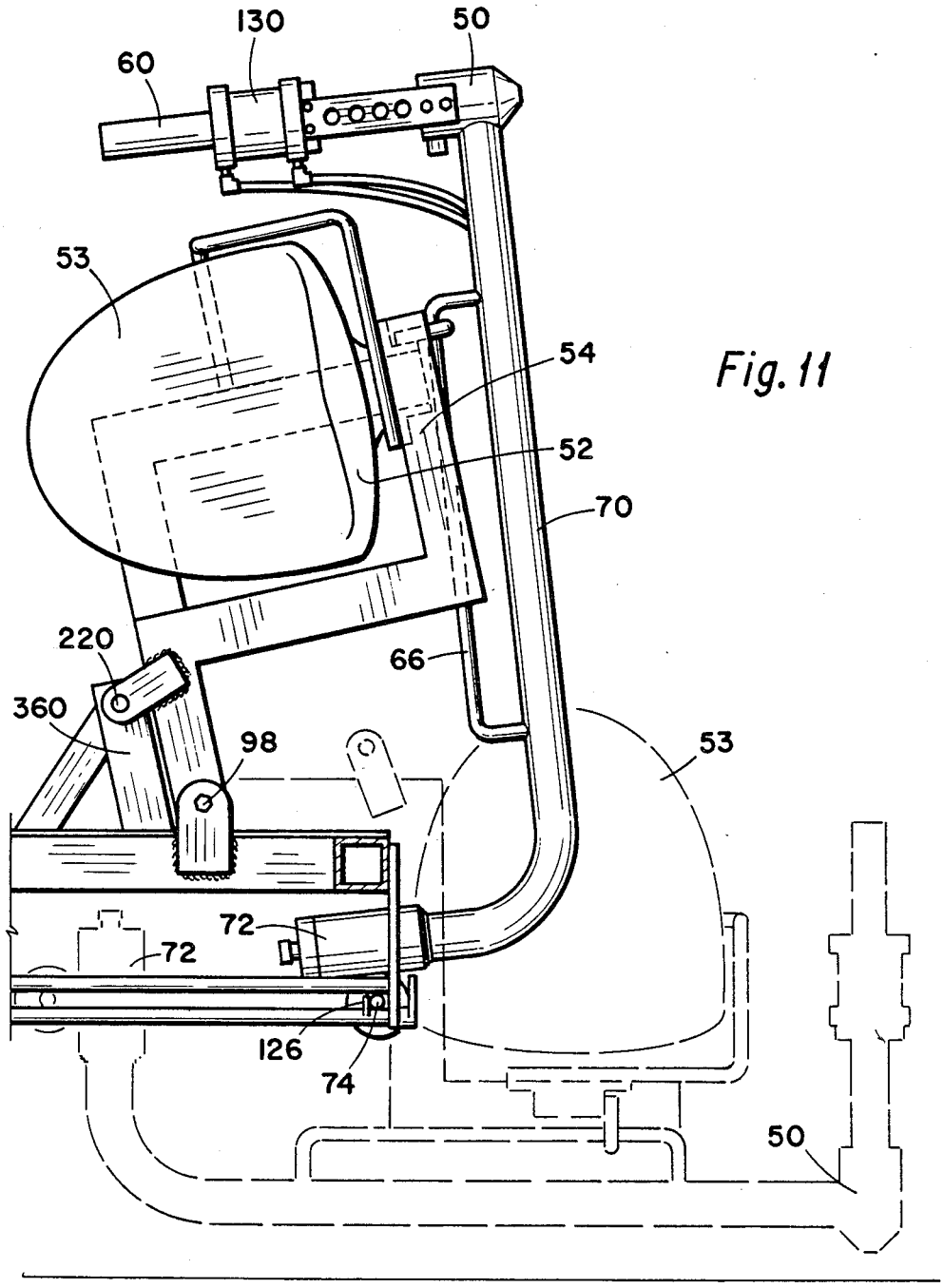
FIG. 11 shows the dispensing valve and seat assembly raised and locked in a traveling position.

As shown in FIG. 4 there is a locking cam 126 placed on swivel support bar 78 which can be rotated by locking handle 128. As shown in FIG. 11 this locks short slide bar 74 in its outermost position which is needed when the seat is folded up as shown in FIG. 11 to hold the seat and section 70 in the proper position.

Figure 10:
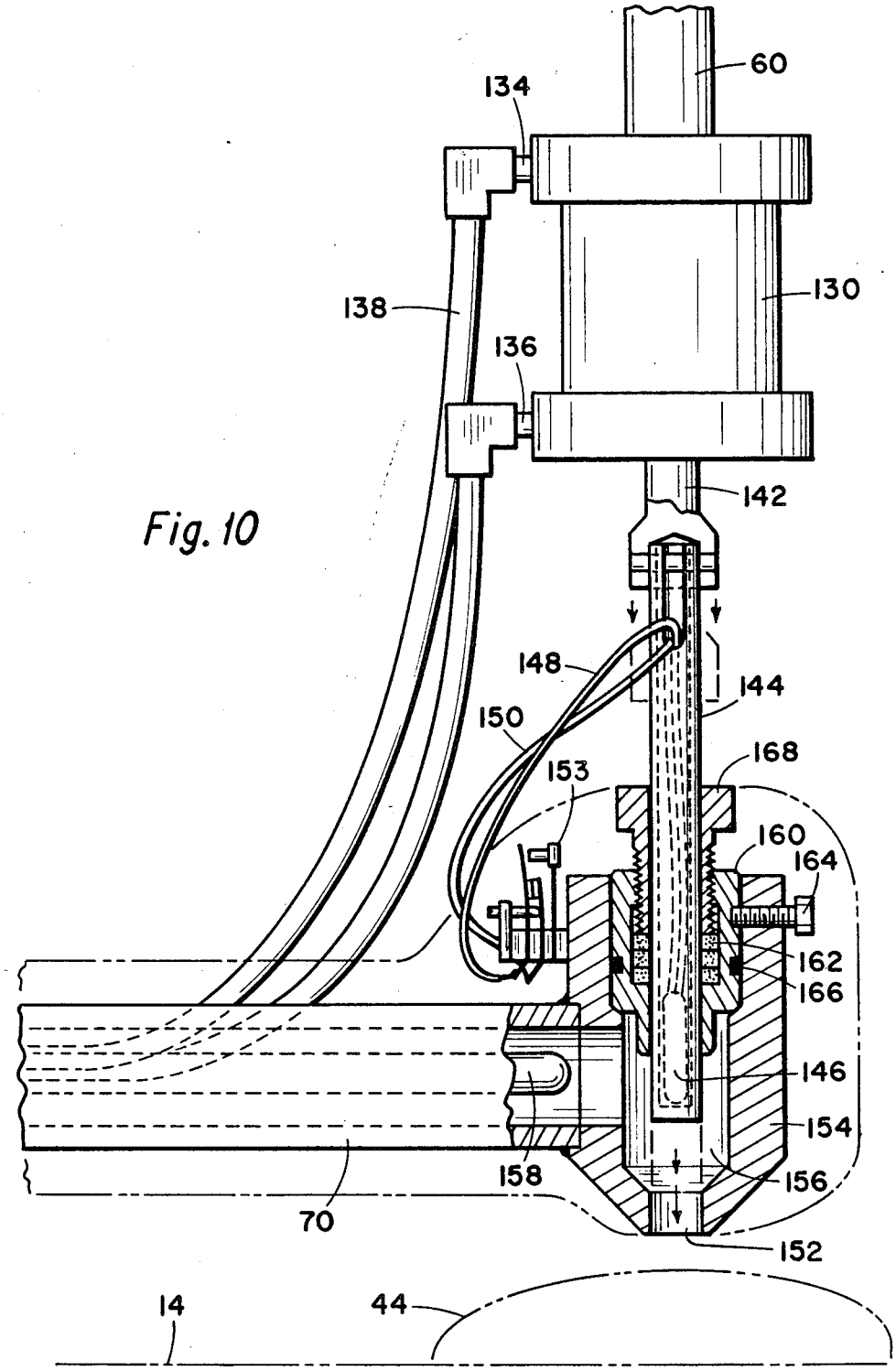
FIG. 10 is a view partially in section of the quick action nondrip dispensing valve.

Still referring to FIG. 4, a dispensing valve drive motor 130 is supported above dispensing valve 50 by dispensing bars 132 which has holes therein for aiding in the dispensing of heat. Dispensing valve drive motor 130 has an upper inlet 134 and a lower inlet 136 which are connected to air supply hose 138 and 140 respectively. A piston in the housing of drive motor 130 is connected by piston rod 142 as shown in FIG. 10 to drive the rod valve 144 which will be discussed later. It is suffice to say now that by injecting air in 134 and out 136 the piston rod 142 will be driven downwardly and when the air under pressure is injected through inlet 136 and out port 134 the piston rod 142 will rise.

Attention is now directed to FIG. 10 which shows partly in cross section the dispensing valve just discussed. It includes an elongated rod valve 144 which its outside diameter closely fits the inside diameter of orifice 152 in the base of the housing 154 of the dispensing valve 50. The rod valve 144 is driven by pneumatic motor 130 between its upper position, as shown in FIG. 10 and a lower position, in which the lower end of the rod valve 144 extends slightly through or just into orifice 152 so that fluid cannot flow therethrough. By having a very close tolerance between the outer surface of rod valve 144 and the inner surface of orifice 151 I obtain a drip-free valve when used with hot liquid Bitumen. The lower end of housing 154 has a chamber 156 which is in open fluid communication with the interior of dispensing conduit section 70 which has an internal heating element 158. A packing housing is held in position by set screw 164 and has a seal 166 which seals with the housing 154. There is an internal packing chamber for packing 162 which fits snugly against the exterior wall of rod valve 144. This packing is held in position by packing gland screw 168. The purpose of packing 162 is to wipe the rod valve 144 clean so as it is driven to the upper position as shown in FIG. 10 there will be no adhesive such as the Bitumen thereon which could harden and when it cools outside of the valve housing 146 and would cause the valve to become inoperative. There is a heating element 146 within rod valve 144 and it is heated by energy transmitted through conduits 148 and 150. A thermostat 152 is provided so that the valve will not overheat.

Figure 6:
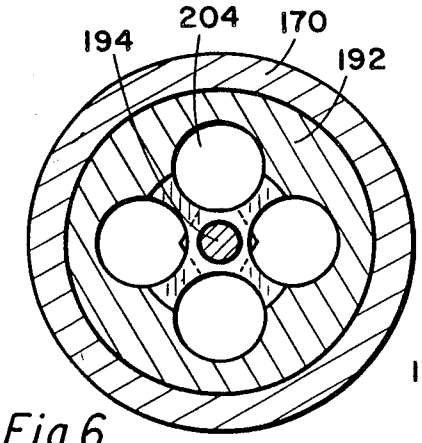
FIG. 6 is a view taken along the line 6—6 of FIG. 5.
Figure 5:
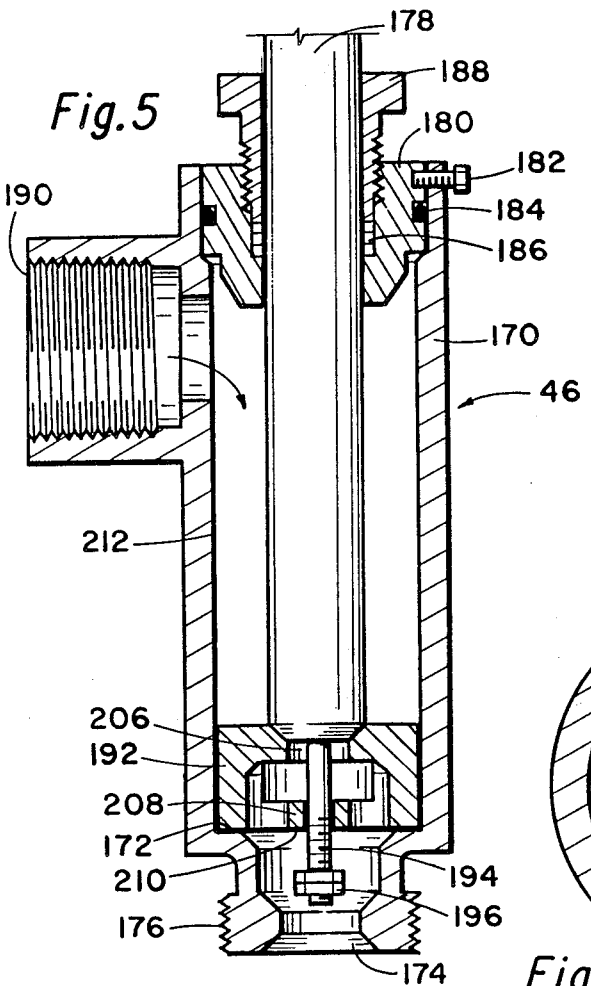
FIG. 5 shows a cross sectional view of a pump with a free floating piston and in the end of its downstroke.

Attention is next directed to FIGS. 5 and 6 to show the construction of the pump 46 with the free floating piston. This include a cylindrical housing 170 which has an internal annular shoulder 172 in the lower end thereof with an orifice or outlet passage 174 with threads 176 which may be attached to a conduit. A pump rod 178 extends out the top of the housing 170. A packing housing 180 is held in position by set screw 182 and has a circular passage therethrough which is slightly larger than the circumference of pump rod 178. A seal 184 is provided between packing housing 180 and internal wall of housing 170. A packing 186 is provided in packing housing 180 and is held in position by packing gland screw 188. Packing 186 is provided to wipe the pump rod 178 clean as it moves upwardly so that there will not be any adhesive such as liquid Bitumen on the walls thereof which would harden when it cools and would make the pump inoperative. There is an inlet 190 in the wall of cylindrical housing 170 near the upper end where the packing housing is located. A free floating piston 192 is slidably supported on stem 194 which extends downwardly from and supported by pump rod 178. A stop such as nut 196 is provided on the lower end of stem 194. Piston 192 can move with respect to stem 194 from the position shown in FIG. 5 to the position shown in FIG. 8. Piston 192 has a valve seat 198 in its upper side just above passage 206. The lower end of pump rod 178 is provided with a valve 202 which seats end valve seat 198 as shown in FIG. 5 and in FIG. 9. When pump rod 178 is in an upper position away from valve seat 198 there is a fluid passage from beneath the piston to above the piston. This is through passages 204 which communicates with fluid chamber 206 which is just below valve seat 198. There is a webbing 208 with vertical ports 204 therethrough and a centrally located passage through which support stem 194 passes and there is a surface 210 around this passage which nut 196 will abutt when the piston is in its lowermost position such as shown in FIG. 7.

Figure 7:
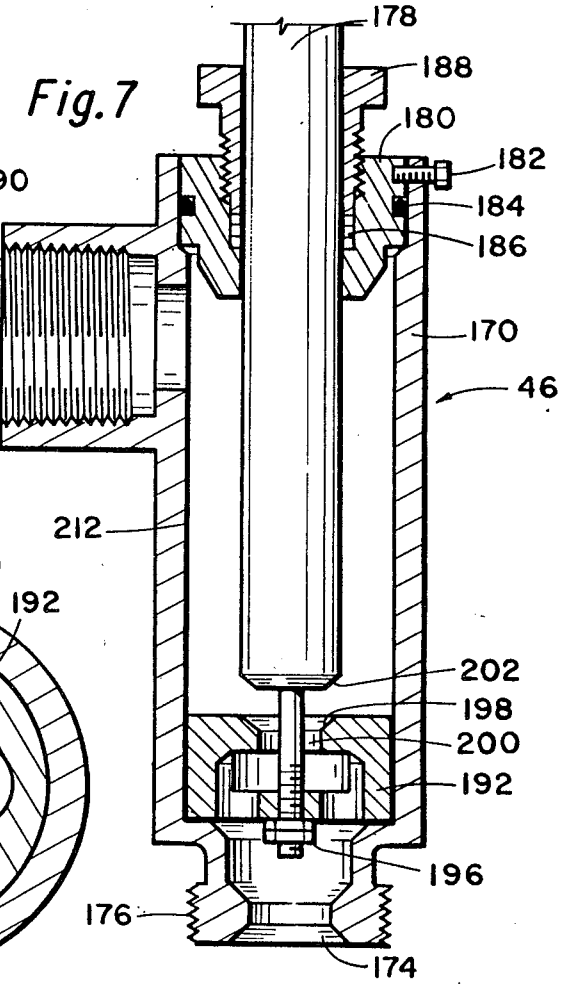
FIG. 7 is similar to FIG. 5 and shows the next sequence which is the beginning of the upstroke of the pump.
Figure 9:
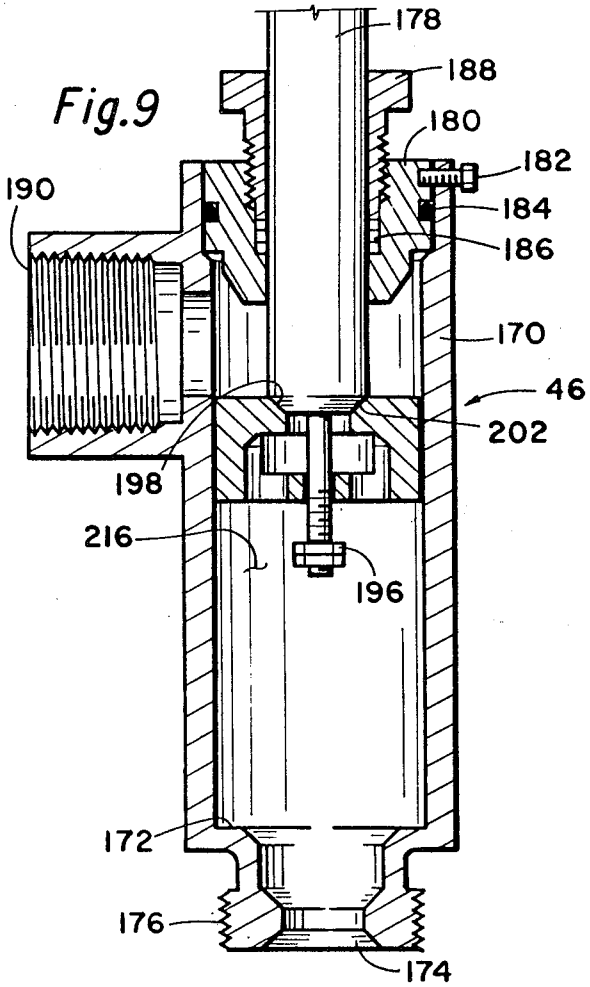
FIG. 9 shows another sequence from the pump of FIG. 8 which shows the pump at the beginning of its downstroke.
Figure 8:
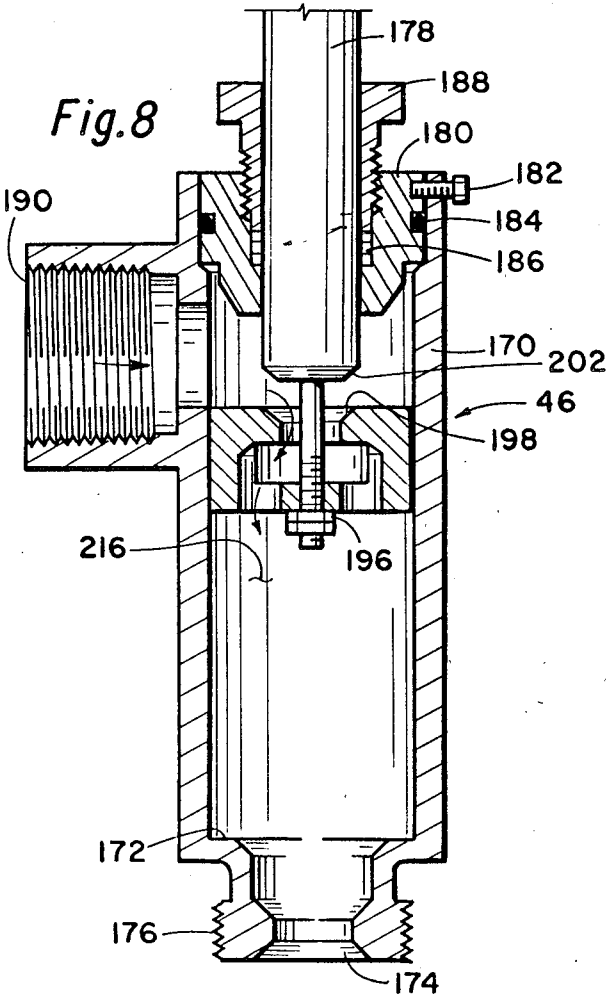
FIG. 8 is similar to FIG. 7 but shows another sequence of operations in which the piston is at the end of its upstroke.

The components of FIGS. 7, 8 and 9 are identical to that of FIG. 5. However, by studying these four figures one can readily see the operations thereof. In FIG. 5 the pump rod 178 is in its lowermost position and has just driven the adhesive material out through outlet 174.

Adhesive material will be drawn in during this operation through inlet 190 from the vat 20 through the inlet into the annular space 212 between the lift pump rod 178 and the cylindrical housing 170. If lock safety valve 64 shown in FIG. 1 is open then air can be admitted to the lower side of the cylindrical motor 48 to drive the pump rod 178 upwardly inasmuch as it is connected to the piston rod 110. This is as shown in FIG. 7 where valve 202 is being lifted from the seat 198 and the lift nut 196 is against the surface 210 of the webbing. As the pump rod 178 is continually lifted up as shown in FIG. 8 there is generated a vacuum in the space 216 beneath the free floating piston 192. As free floating piston 192 is raised, the flow of the adhesive material is indicated by the arrows. It flows in through inlet 190 and down through the vertical openings in free floating piston 192 inasmuch as the valve 202 is off of valve seat 198. The weight of the valve 192 causes it to seek its lower position against the nut or support 196. The cylindrical motor 48 is adjusted to have a stroke such that when it is in its upper position the top of free floating piston 192 is just even with about the lower end of the inlet 190 as it enters through the wall of housing 170. At this point the air control is shut off to the lower side of the piston and cylinder motor 48 and applied to the upper side. When the piston in the cylinder motor 48 is driven downwardly it of course drives the pump rod 178 in a downward position. The beginning of the downward stroke is shown in FIG. 9 the valve 202 seats against seat 198 and no fluids can flow upwardly through the piston 196. Thus, further downward movement of the pump rod 178 drives the piston 192 downwardly and causes the liquid adhesive to flow out outlet 174.

When it is desired to deposit an adhesive on the surface 14 the operator sitting in seat 52, will hit the foot switch 58 with his foot. When one steps on foot switch 98 it operates a solenoid operated spring return air valve which in a first position connects air from the air pressure tank 38 to the top of the piston in pump cylinder 48 to drive the free floating piston 192 downwardly as shown in FIG. 9. Foot switch 58 is held closed a sufficient time to permit full action of the pump cylinder 48. At the same time air is out from underneath the piston so that the air can drive the free floating piston 192 downwardly so that the adhesive will be driven out of the chamber 216 through outlet 174 and through the conduit 68 and 70. At the same time that the air is admitted to the top of the pump cylinder 48 air is injected to the lower side of pneumatic motor or cylinder 130 through inlet 136 and the pressure is relieved from the top side through outlet 134 so that the piston in pneumatic cylinder 130 will be driven up which will open the dispensing valve 50 by lifting rod valve 144 up out of orifice 152 to the position shown in FIG. 10. The air to cylinder motor 48 is regulated to about 40 psi in one of these applicators that I have built and the pump had an inside diameter of about 2½ inches. The air to this pneumatic cylinder 130 for operating the dispensing valve 50 in the applicator I built has a 1½ inch cylinder and the air is regulated to operate it at 90 p.s.i. Thus, because of the differences in volume and the pressure I am assured that dispensing valve 50 will always open before the pump 46 operates. Therefore there is no build up of pressure internally. The solenoid valve are spring loaded and will return to their normal position in which the air channels and flow are such that the dispensing valve 50 will be closed because air will be directed through inlet 134 and valve 46 will be in its uppermost position because the air has been applied to the lower side of the piston in cylindrical motor 48 to drive it to the position shown in FIG. 8.

Figure 12:
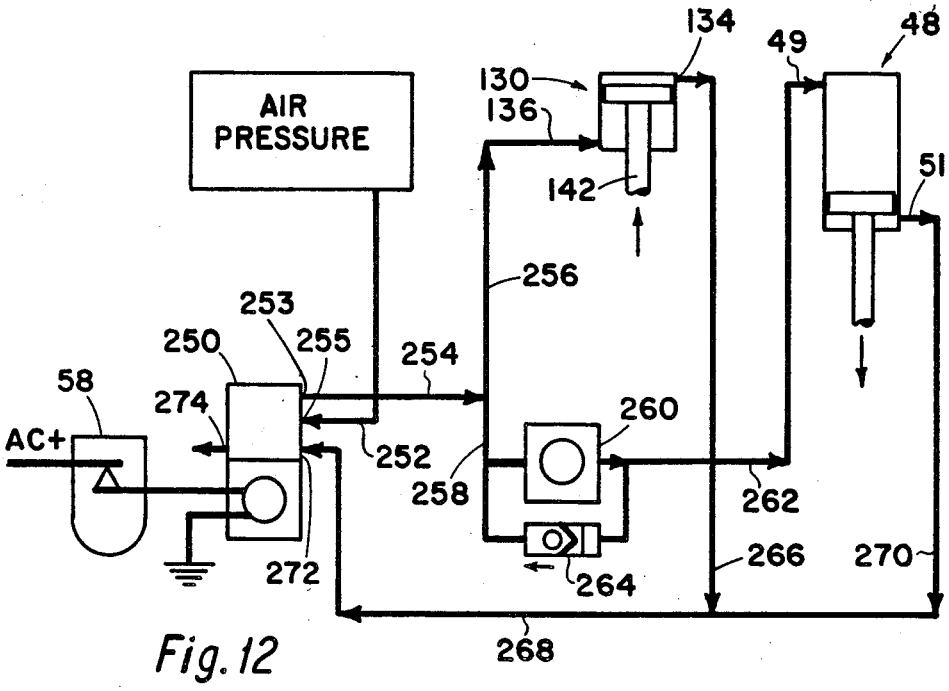
FIG. 12 is a schematic diagram showing the air control system when the solenoid is engaged.
Figure 13:
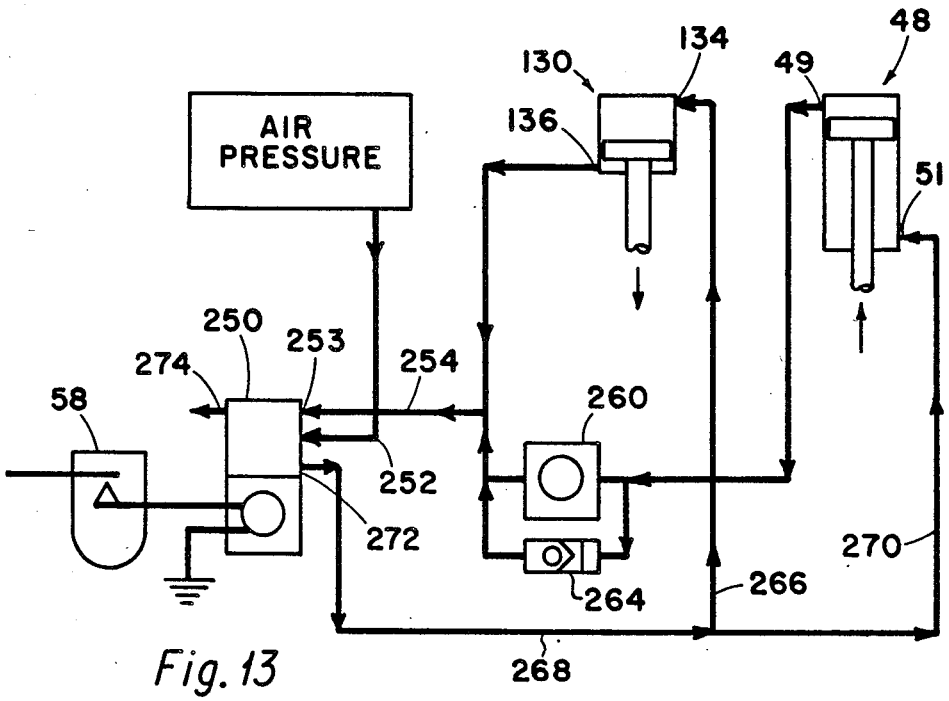
FIG. 13 is similar to FIG. 12 but illustrates the air flow when the solenoid valve is disengaged.

Attention is next directed to FIGS. 12 and 13 which shows a schematic of the air control system. A solenoid spring return air valve 250 is provided and is actuated by electrical current through switch 58. The solenoid is of a type that air from pressure tank 38 is provided through conduit 252, through port 253 and air pressure conduit port 254 so that when solenoid valve 250 is operated the high pressure air from source 252 flows out conduit 254 and air in conduit 268 is exhausted through exhaust port 274. One branch of the conduit is 256 which leads to input 136 of pneumatic motor 130 which is used to operate dispensing valve 50. A second conduit branch 258 is supplied to pressure regulator 260 which has an outlet conduit 262 which connected to the inlet 49 of cylinder motor 48 which is above the piston of that motor which operates pump 46. A check valve 264 is provided in a bypass around air regulator 260 and permits flow of air only in the direction indicated by the arrow. Outlet 134 of pneumatic motor 130, which is above the piston, is connected through a conduit 266 which connects to conduit 268. The outlet 51 of pneumatic cylinder 48 is connected from port 51 which is below the piston through conduit 270 to connect to conduit 268 which connects to the input 272 of the solenoid valve 250. The solenoid valve 250 has an outlet 274 which is vented to the atmosphere. When the solenoid 250 is engaged, the high pressure air flows through the conduits 254 and 256 and inlet 136 to force the piston in pneumatic cylinder 130 upwardly. Rod valve 142 is then in an open position shown in FIG. 10. At the same time, high pressure air is provided through conduit 258 to regulator 260 which typically reduces it from about ninety pounds to about forty pounds but may be up to about eighty pounds depending on factors such as atmospheric temperature and temperature of the Bitumen or adhesive being pumped and permits the outlet air through conduit 262 to input 49 of cylindrical motor 48 which drives piston 192 of pump 46 to its lowermost position as shown in FIG. 5 to pump liquid Bitumen. The output air below piston 192 is vented through outlet 51 back through conduits 270, 268 and out the outlet 274 of the solenoid valve 250. Likewise, the air above the piston in cylindrical valve 130 is vented through outlet 134, conduits 266 and 268 through the outlet 274 of the solenoid valve 250. This action which is originated by the operator hitting foot switch 58 with his foot, causes rod valve 144 to open and causes the pump 48 to operate to drive hot Bitumen through the dispensing conduits and dispensing valve 50.

FIG. 13 shows the same configuration as that of FIG. 12 except that it indicates the flow of air when the solenoid 250 is disengaged. As can be seen switch 58 is opened. When in this position the solenoid valve operates so that the high pressure air from conduit 252 goes out port 270 through conduit 268 and branch conduit 266 to drive the piston and pneumatic motor 130 downwardly as indicated by the arrow below the piston rod and also it conveys air through branch conduit 270 and inlet 51 of the cylindrical motor 48 to drive the piston upwardly as indicated by the arrow. Thus this action of motor 130 closes dispensing valve 50 and the movement of the piston 192 in the cylinder motor 48 causes pump 46 to be in the upper position as shown in FIG. 8. When in this position the solenoid valve which is commercially available, causes the air from the bottom side of the piston in pneumatic motor 130 to be discharged through outlet 274 and the air from the upper side of the piston in pneumatic motor 48 to be discharged through outlet 49 through the bypass and check valve 264 around the regulator 260 to be discharged.

Attention is now directed to FIGS. 14, 15, 16 and 17 to show details of the swivel assembly 72. This swivel assembly housing includes a first tubular or cylindrical member 314 and a second tubular member 300 whose longitudinal axis lies in a plane perpendicular to the longitudinal axis of member 314. A passage 308 in connecting member 309 connects the systems of these tubular members 300 and 314. These parts are made integral. Attention is first directed to FIGS. 14 and 15 which show plan view of the swivel connection which permtis lateral conduit 70 to pivot in a horizontal plane. Tubular member 300 which may be called a vertical pivot housing has a cylindrical space 302 therein into which upwardly extending conduit member 304 extends in a sealing rotatable fit. The tubular member 304 is an upward extension of dispensing section 70. There is a slot 306 cut in the wall of conduit 304 and extends approximately 120°. A lateral passage 308 communicates between the interior 310 of tubular member 312 and interior 302 of tubular member 300. Section 312 extends into tubular member 314. Seals 316 provides a sealing contact between inner section 312 and section 314. Means 318 and 320 such as lock rings hold the part 312 and 314 together. A heating conduit 322 extends within the space 310. Section 70 then can rotate within the pivot 300 at least 90° and still not shut off the flow of the hot Bitumen through passage 308 into dispensing conduit 70. This is important so that the operator can guide the dispensing valve 50 and still maintain a flow of fluid adhesive.

Figure 17:
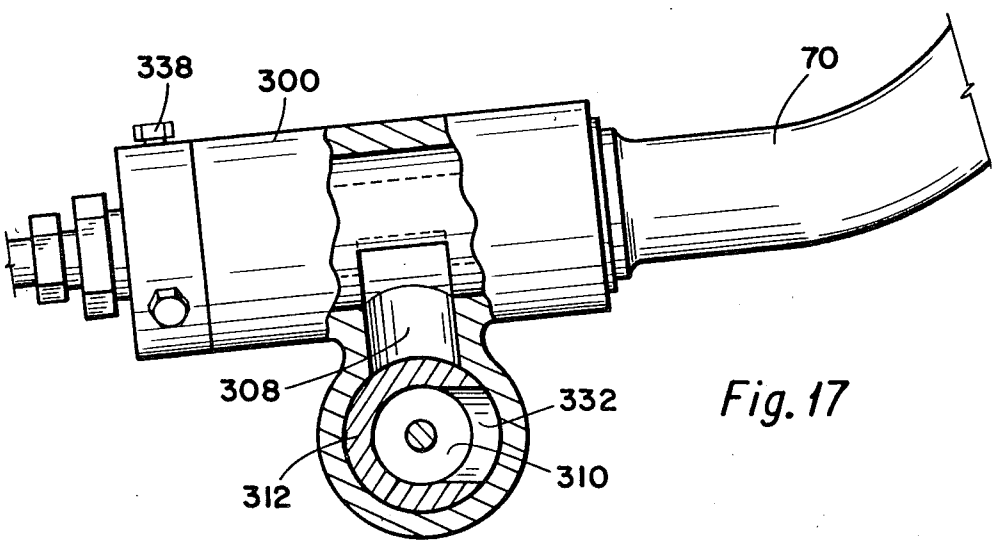
FIG. 17 is a shut off position of the device shown in FIG. 16.
Figure 16:
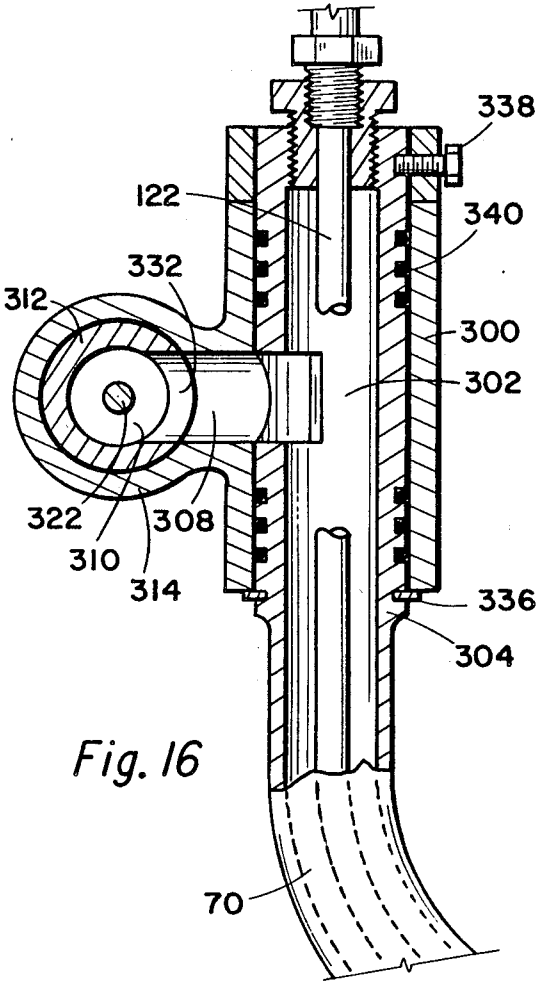
FIG. 16 is a front elevation view partly in section of the swivel assembly 72.

Attention is now directed to FIGS. 16 and 17 which show a front elevational view. FIG. 16 is partly in section and FIG. 17 is also partly in section. FIG. 16 shows the flow through position and FIG. 17 shows the shut off position which occurs when dispensing valve 50 is lifted as shown in FIG. 11.

Figure 15:
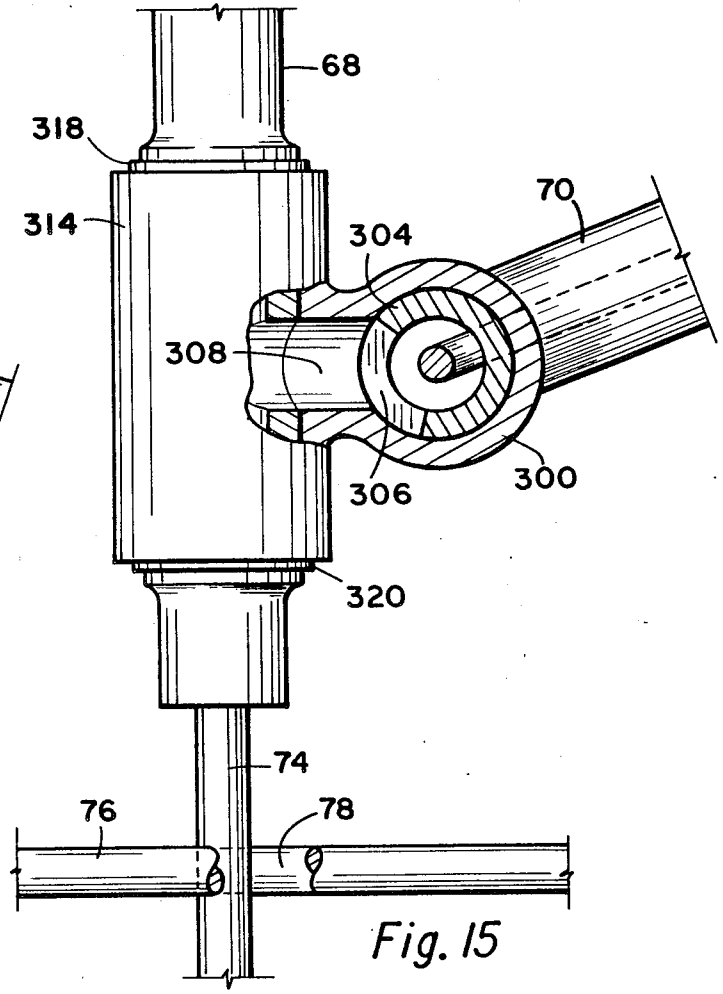
FIG. 15 is also a plan view of the swivel apparatus of FIG. 14 but with the dispensing section rotated.
Figure 14:
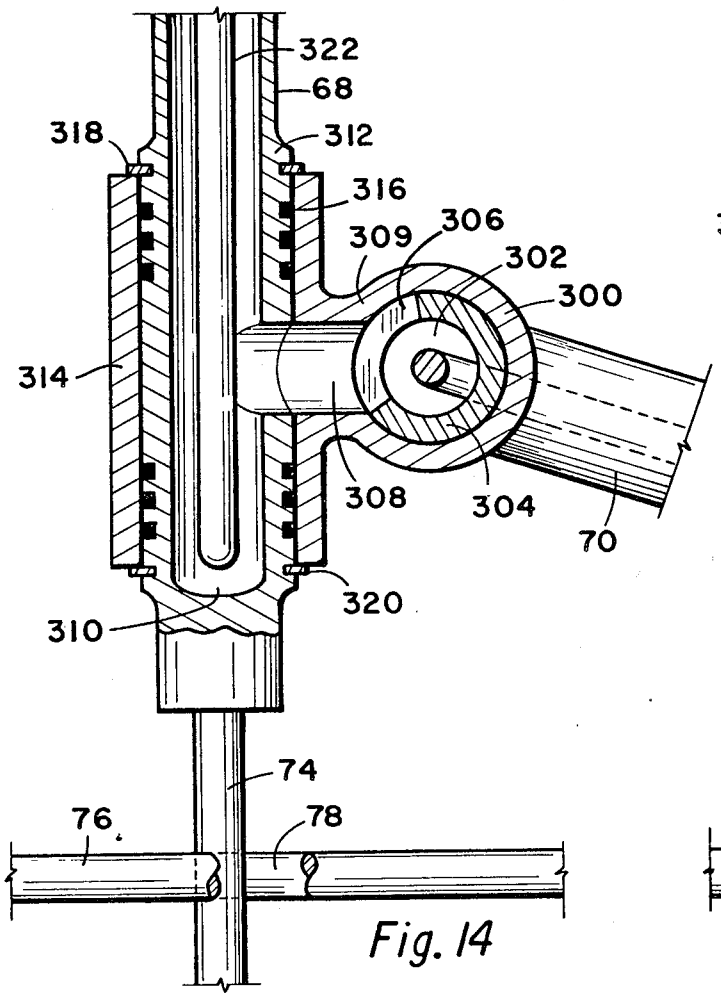
FIG. 14 is a plan view partially in section of the swivel assembly 72.

We will now discuss FIGS. 16 and 17 which shows means for permitting the seat, the dispensing valve 50 and the dispensing conduit 70 to be rotated upwardly to provide positive shut off by this motion. The tubular housing portion 314 on whose axis it is desired to rotate the element 314 about element 312 which is fixed to pipe dispensing segment 78 which goes to the pump 46. The interior 310 of section 312 is in fluid communication with the interior 302 of section 300. Section 300 houses the upper end of an enlarged section 304 which has an interior which is in fluid communication with dispensing section 70 which connects to valve 50. Section 312 then does not rotate but has an opening 332 which connects with the passage 308 which is a cylindrical passage fluidly connecting the interior of section 314 and the interior of section 300. Section 314 is essentially a cylindrical section having an interior 310 and section 300 is also a tubular section having an interior 324. The direction of the longitudinal axis of section 332 and 314 are perpendicular. In other words one section has a longitudinal axis which is vertical and another section is horizontal in the position shown in FIGS. 14, 15 and 16. A cylindrical passage 308 connects the interior 310 of tubular section 314 and interior 324 of tubular section 300 when opening 332 of member 312 is aligned with passage 308 as shown in FIG. 16. Enlarged section 214 is tubular and connects with dispensing section 70 and is secured by locking rings 336 and screw 338. Seals 340 are provided between tubular member 300 and tubular member 332. Section 300 can rotate so that the opening 306 is always open as indicated in FIGS. 14 and 15 during normal operation of this device. On the other hand, the openng 332 in element 312 is such that when in the position shown in FIG. 16 with the section 70 in its normal operating condition opens with respect to passage 334 so that there is fluid communication between the interior 310 of vertical section 314 and the interior 324 of section 304. However, as can be seen in FIG. 17 when it is desired to lift the dispersing valve 50 up to the carrying position then the port 332 is away from the opening into passage 308 and thus it is sealed. This is another safety feature providing positive shut off.

Figure 18:
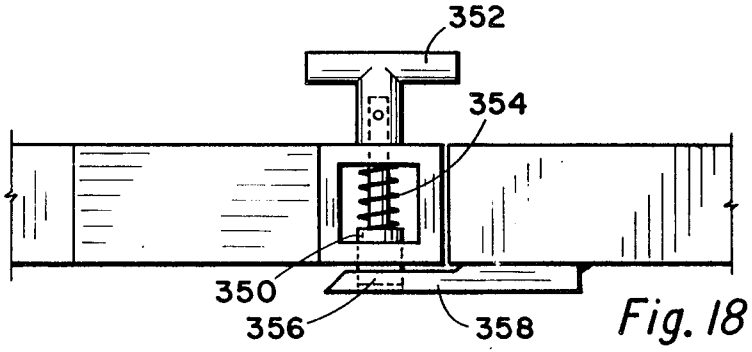
FIG. 18 is a view taken along line 18—18 of FIG. 11.

Attention is now directed to FIG. 11. When pulling the thermal adhesive applicator down the highway when not in use the operator seat and dispensing valve 50 should be raised. This is illustrated in FIG. 11. When in the dashed line the dispensing valve and the seat back 53 are all in the position in which they would be when being operated. When it is desired to lift the seat mechanism and the dispensing mechanism one first pulls the dispensing mechanism all the way to the right so that short slide bar 74 is in the solid position in the position indicated by the solid lines. At this time locking handle 128 is rotated so that locking cam 126 is in the position shown in FIG. 11. This prevents the swivel assembly 72 moving back toward its inner position or to the left. Attention is now directed to FIG. 18 which shows a view along the line 18—18 of FIG. 11. This shows a spring loaded locking bolt which includes a locking rod 350 with handle 352 which is spring loaded by springs 354 to drive the locking bolt 350 into receiving notch 356 which is in a latch 358 of the frame 360. Section 70 and the frame 54 for the housing is then rotated about the pivot in swivel assembly 72 and pivot 98 respectively, until it is in the position indicated or shown in FIG. 11. When in this position a locking pin 220 is applied to lock the seat frame 54 to the lock support bar 360 which is attached to the main frame 10. When in this position the valve inside the swivel joint 72 closes so that no fluid can accidentally flow through the dispensing conduit section 70. As another safety precaution at this time the valve 64 which provides air to the underside of the piston in cylinder motor 48 is closed. The air pressure in the cylinder motor 48 below the piston prevents the piston from going up.

The cost of installing reflectors when using my method is only about fifty percent of the previous costs of installing reflectors. This is a major reduction.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A dispensing system for heating and dispensing hot materials which comprises:

a vat having an outlet and used for holding the material;

heating means to heat said vat;

a pump assembly connected to said outlet of said vat;

a frame supporting said vat;

a hot material dispensing conduit means having a first section and a second section, said first section having an end A and an end B, said end A being pivotally connected to the outlet of said pump;

said second section having an end C, and an end D;

a swivel assembly connecting end C to said end B;

a dispensing valve connected to said end D;

means to support said swivel assembly from said frame;

an elongated support hook fastened to said second section and having an element substantially parallel to the second section;

a support hook support rod supported from said frame and extending between said support hook and said second section;

a handle attached to said dispensing valve so that said dispensing valve may be guided.

2. A dispensing system as defined in claim 1 in which said pump assembly includes:

a cylindrical housing having a first end and a second end and an outlet at the first end thereof which forms an annular shoulder in said cylindrical housing;

an inlet to the interior of said cylindrical housing near the second end in the walls of said housing;

a cap means with a cylindrical passage therethrough enclosing the second end of said cylindrical housing;

a lift rod extending through said passage into said housing;

a piston stem extending from the end of said lift rod in said housing;

a piston having a first and second side and a passage therethrough and slidably mounted inside said cylindrical housing on said stem and having a centrally positioned valve seat in said passage;

stop means on the lower end of said piston stem rod, said piston having slidable movement between said stop means and said lift rod.

3. A dispensing system as defined in claim 1 in which said dispensing valve includes:

a housing having an interior, a first end and a second end each having a passage therethrough which are axially aligned and an inlet in the walls thereof which opens into said interior;

a cylindrical rod valve slidably extending through said passage and with a sealing fit;

electrical means for heating the inside of said rod valve.

4. A dispensing system as defined in claim 1 in which said swivel assembly is used for connecting a first conduit and a second conduit and which includes:

a first hollow cylindrical housing having a first interior;

a second hollow cylindrical housing having a second interior and whose longitudinal axis lies in a plane perpendicular to the longitudinal axis of said first cylindrical member;

a passage extending from said first interior to said second interior;

a first cylindrical insert for inserting into said first cylindrical housing and connectable to said first conduit, there being an opening in the wall thereof which when the first housing is in one position there is fluid communication between the first interior and the said passage;

a second cylindrical insert connectable to said second conduit and insertable into said second housing and having an opening in the wall thereof communicating with said passage when the second insert is in one rotational position with respect to the second housing and when in a second rotational position there is no fluid communication.

5. A dispensing system as defined in claim 1 including:

an air control system including a solenoid valve and such that when the solenoid is in one position, air under pressure is directed to drive said pump assembly to its filling position and said dispensing valve to its closed position and when said solenoid valve is in a second position to direct air to operate the pump assembly to pump a hot material and to cause said dispensing valve to be opened.

6. A dispensing system as defined in claim 5 including a pressure regulator so that the pressure directed to drive said pump assembly is less than that directed toward said dispensing valve.

7. A dispensing valve for discharging a puddle of hot material which comprises a housing having an interior cavity, a first end and a second end with an axially aligned passage and a discharge bore at said second end, a heated material inlet in the wall of said housing which communicates with said interior cavity between said first end and said discharge bore, a cylindrical rod valve reciprocably positioned in said interior cavity and sealed relative to said first end so as to move between a first position closing said bore and a second position opening said bore for a moment of time sufficient for the flow of a desired quantity of said hot material from said interior cavity, means to reciprocate said rod valve; and an electrical heating means and thermostat means inside said rod valve to prevent solidification or cooling of said material that is located in said interior.

8. A valve as defined in claim 7 wherein said means to reciprocate said rod valve is a pneumatic motor.

* * * * *